US009073556B2

(12) United States Patent
Foege et al.

(10) Patent No.: US 9,073,556 B2
(45) Date of Patent: Jul. 7, 2015

(54) FUEL DISTRIBUTION SYSTEM FOR MULTI-LOCOMOTIVE CONSIST

(75) Inventors: Aaron Gamache Foege, Westmont, IL (US); Edward John Cryer, Homer Glen, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 206 days.

(21) Appl. No.: 13/563,220

(22) Filed: Jul. 31, 2012

(65) Prior Publication Data

US 2014/0033943 A1 Feb. 6, 2014

(51) Int. Cl.

| | |
|---|---|
| ***B61C 17/00*** | (2006.01) |
| ***B61D 5/00*** | (2006.01) |
| ***F17D 1/00*** | (2006.01) |
| ***B61C 5/00*** | (2006.01) |
| ***B61C 17/02*** | (2006.01) |

(52) U.S. Cl.

CPC . *B61C 17/00* (2013.01); *B61D 5/00* (2013.01); *F17D 1/00* (2013.01); *B61C 5/00* (2013.01); *B61C 17/02* (2013.01)

(58) Field of Classification Search

CPC ..... B61C 3/00; B61C 17/00; B61C 17/02; B61C 5/00; B61L 11/00; B61L 11/003; B61L 11/26; B61L 11/005; B61L 11/12; B61L 11/123; B61L 11/14; B61L 1/003; B61L 1/02; B61L 1/14; B61L 7/04; B61L 7/06; B61L 7/14; B61L 9/02

USPC ..... 105/1.4, 231, 236, 287, 288, 289; 246/187 A

See application file for complete search history.

(56) References Cited

U.S. PATENT DOCUMENTS

| | | | |
|---|---|---|---|
| 308,948 | A | 12/1884 | Bruce |
| 331,716 | A | 12/1885 | Katz |
| 338,028 | A | 3/1886 | Bower |
| 3,352,294 | A | 11/1967 | Biller et al. |
| 3,406,526 | A | 10/1968 | Lusk |
| 3,473,341 | A | 10/1969 | Mulder |
| 4,137,006 | A | 1/1979 | Becker |
| 4,359,118 | A | 11/1982 | Latter et al. |
| 4,551,065 | A | 11/1985 | Becker |

(Continued)

FOREIGN PATENT DOCUMENTS

| | | |
|---|---|---|
| DE | 102009042256 | 4/2011 |
| EP | 0 069 717 | 12/1983 |

(Continued)

OTHER PUBLICATIONS

Foege, "Consist Having Self-Powered Tender Car", U.S. Appl. No. 13/563,154, filed Jul. 31, 2012.

(Continued)

*Primary Examiner* — Jason C Smith

(74) *Attorney, Agent, or Firm* — Finnegan, Henderson, Farabow, Garrett & Dunner, LLP

(57) ABSTRACT

The disclosure is directed to a fuel distribution system for a consist. The fuel distribution system may have a first locomotive, a second locomotive, and a tender car. The fuel distribution system may also have at least one pump located onboard the tender car, and at least one fluid conduit attached to the at least one pump. The at least one fluid conduit may be configured to deliver gaseous fuel from the tender car to the first and second locomotives.

15 Claims, 4 Drawing Sheets

(56) References Cited

U.S. PATENT DOCUMENTS

| | | | | |
|---|---|---|---|---|
| 4,630,572 | A | 12/1986 | Evans | |
| 4,646,701 | A | 3/1987 | Fukumoto | |
| 5,129,328 | A | 7/1992 | Donnelly | |
| 5,269,225 | A | 12/1993 | Bosshart et al. | |
| 5,375,580 | A * | 12/1994 | Stolz et al. | 123/527 |
| 5,461,873 | A | 10/1995 | Longsworth | |
| 5,513,498 | A | 5/1996 | Ackermann et al. | |
| 5,544,483 | A * | 8/1996 | Heuer | 60/283 |
| 5,567,105 | A | 10/1996 | Williams | |
| 5,609,141 | A * | 3/1997 | Matsuoka et al. | 123/520 |
| 5,692,458 | A | 12/1997 | Green | |
| 5,887,567 | A * | 3/1999 | White et al. | 123/294 |
| 6,408,766 | B1 * | 6/2002 | McLaughlin et al. | 105/231 |
| 6,460,517 | B1 | 10/2002 | Dauer | |
| 6,506,018 | B1 | 1/2003 | Brennan | |
| 6,615,118 | B2 * | 9/2003 | Kumar | 701/19 |
| 6,698,211 | B2 | 3/2004 | Gustafson | |
| 6,701,721 | B1 | 3/2004 | Berchowitz | |
| 6,725,134 | B2 | 4/2004 | Dillen et al. | |
| 6,807,812 | B2 | 10/2004 | Lehmann et al. | |
| 6,898,940 | B2 | 5/2005 | Gram et al. | |
| 6,907,735 | B2 * | 6/2005 | Wolff et al. | 60/605.1 |
| RE39,599 | E | 5/2007 | Kanamaru et al. | |
| 7,231,877 | B2 * | 6/2007 | Kumar | 105/35 |
| 7,304,445 | B2 * | 12/2007 | Donnelly | 318/108 |
| 7,308,889 | B2 * | 12/2007 | Post et al. | 123/527 |
| 7,373,931 | B2 * | 5/2008 | Lennox et al. | 123/525 |
| 7,412,835 | B2 | 8/2008 | Legall et al. | |
| 7,430,967 | B2 * | 10/2008 | Kumar | 105/35 |
| 7,434,407 | B2 | 10/2008 | Haberbusch et al. | |
| 7,448,328 | B2 * | 11/2008 | Kumar | 105/35 |
| 7,631,635 | B2 * | 12/2009 | Hochstein et al. | 123/516 |
| 7,689,341 | B2 * | 3/2010 | Miller | 701/70 |
| 7,765,859 | B2 * | 8/2010 | Connell et al. | 73/121 |
| 8,015,808 | B2 | 9/2011 | Keefer et al. | |
| 8,056,540 | B2 * | 11/2011 | DeBastos et al. | 123/521 |
| 8,079,437 | B2 * | 12/2011 | Rosman | 180/165 |
| 8,095,253 | B2 | 1/2012 | Kane et al. | |
| 8,112,191 | B2 * | 2/2012 | Kumar et al. | 701/22 |
| 8,196,518 | B2 | 6/2012 | Bachman | |
| 2003/0233959 | A1 * | 12/2003 | Kumar | 105/26.05 |
| 2004/0149254 | A1 * | 8/2004 | Piock | 123/295 |
| 2005/0279242 | A1 * | 12/2005 | Maier et al. | 105/26.05 |
| 2006/0005736 | A1 * | 1/2006 | Kumar | 105/1.4 |
| 2008/0000381 | A1 * | 1/2008 | Bartley et al. | 105/49 |
| 2008/0083576 | A1 * | 4/2008 | Read | 180/165 |
| 2008/0121136 | A1 * | 5/2008 | Mari et al. | 105/35 |
| 2008/0302093 | A1 * | 12/2008 | Montgomery et al. | 60/299 |
| 2009/0187291 | A1 * | 7/2009 | Daum et al. | 701/2 |
| 2009/0234521 | A1 * | 9/2009 | Kumar et al. | 701/19 |
| 2010/0019103 | A1 * | 1/2010 | Kane et al. | 246/186 |
| 2010/0070117 | A1 * | 3/2010 | Siffert | 701/19 |
| 2010/0114404 | A1 * | 5/2010 | Donnelly | 701/2 |
| 2010/0175579 | A1 * | 7/2010 | Read | 105/1.4 |
| 2010/0175666 | A1 | 7/2010 | Nishio et al. | |
| 2010/0186619 | A1 * | 7/2010 | Kumar | 104/289 |
| 2011/0061364 | A1 * | 3/2011 | Raman | 60/274 |
| 2011/0067390 | A1 * | 3/2011 | Cook | 60/320 |
| 2011/0162903 | A1 * | 7/2011 | Stragier | 180/165 |
| 2011/0203480 | A1 * | 8/2011 | Donnelly | 105/35 |
| 2011/0217610 | A1 | 9/2011 | Guo et al. | |
| 2011/0257869 | A1 * | 10/2011 | Kumar et al. | 701/103 |
| 2012/0085260 | A1 * | 4/2012 | Nichini et al. | 105/35 |
| 2014/0033941 | A1 * | 2/2014 | Foege et al. | 105/1.4 |
| 2014/0033942 | A1 * | 2/2014 | Foege | 105/1.4 |
| 2014/0033943 | A1 * | 2/2014 | Foege et al. | 105/1.4 |
| 2014/0033944 | A1 * | 2/2014 | Foege | 105/1.4 |
| 2014/0033945 | A1 | 2/2014 | Foege et al. | |
| 2014/0033948 | A1 | 2/2014 | Foege | |

FOREIGN PATENT DOCUMENTS

| | | |
|---|---|---|
| EP | 2 154 044 A2 | 2/2010 |
| EP | 2 154 044 B1 | 1/2012 |
| GB | 1 261 237 | 3/1969 |
| JP | 56 118533 | 9/1981 |
| JP | 60-2197780 | 11/1985 |
| JP | 5 248 599 | 9/1993 |
| JP | 6 033 784 | 2/1994 |
| JP | 6 307 728 | 11/1994 |
| JP | 2000 136756 | 5/2000 |
| JP | 2007 113442 | 5/2007 |
| JP | 2008 201890 | 9/2008 |
| JP | 2010 023776 | 2/2010 |
| RU | 2009142173 | 5/2011 |
| WO | WO 2007/067093 | 6/2007 |
| WO | WO 2008/025158 | 3/2008 |
| WO | WO 2008/037571 | 4/2008 |
| WO | WO 2009/021262 | 2/2009 |
| WO | WO 2010/012252 | 2/2010 |

OTHER PUBLICATIONS

Foege, "Consist Having Self-Propelled Tender Car", U.S. Appl. No. 13/563,114, filed Jul. 31, 2012.

Foege, "Fuel System for Consist Having Daughter Locomotive", U.S. Appl. No. 13/563,242, filed Jul. 31, 2012.

Foege, "Energy Recovery System for a Mobile Machine", U.S. Appl. No. 13/563,414, filed Jul. 31, 2012.

Foege et al, "Energy Recovery System for a Mobile Machine", U.S. Appl. No. 13/562,808, filed Jul. 31, 2012.

Coldren et al., "Consist Power System Having Auxiliary Load Management", U.S. Appl. No. 61/677,770, filed Jul. 31, 2012.

* cited by examiner

FUEL DISTRIBUTION SYSTEM FOR MULTI-LOCOMOTIVE CONSIST

TECHNICAL FIELD

The present disclosure relates generally to a fuel distribution system and, more particularly, to a fuel distribution system for a multi-locomotive consist.

BACKGROUND

Natural gas has been used as fuel for internal combustion engines in consist locomotives. Because natural gas has a lower volumetric energy density than traditional fuels, such as diesel and gasoline, the natural gas used by the locomotives is generally only practical to store in a liquefied state ("LNG"). At atmospheric pressures, the natural gas must be chilled to below about −160° C. to remain in liquid form. Consists having LNG-fueled locomotives store the LNG in insulated tank cars (a.k.a., tender cars) that are towed by the locomotive. An exemplary consist having an LNG-fueled locomotive coupled with a dedicated tender car is disclosed in U.S. Pat. No. 6,408,766 of McLaughlin that issued on Jun. 25, 2002.

Although the conventional method of coupling a dedicated tender car to a single locomotive helps to ensure an adequate supply of fuel for most travel routes, it can also be cumbersome and expensive, while also decreasing an efficiency of a consist. In particular, when multiple locomotives are required to pull a consist, the extra tender cars (one per locomotive) increase a component cost, operating cost, and maintenance cost, and operating complexity of the consist. In addition, the extra tender cars increase an overall weight of the consist and a required capacity and fuel consumption of the locomotives.

The system of the present disclosure solves one or more of the problems set forth above and/or other problems with existing technologies.

SUMMARY

In one aspect, the disclosure is directed to a fuel distribution system for a consist. The fuel distribution system may include a first locomotive, a second locomotive, and a tender car. The fuel distribution system may also include at least one pump located onboard the tender car, and at least one fluid conduit attached to the at least one pump. The at least one fluid conduit may be configured to deliver gaseous fuel from the tender car to the first and second locomotives.

In another aspect, the disclosure is directed to a method of distributing fuel to a consist. The method may include pumping liquefied gaseous fuel from a tender car, and vaporizing the liquefied gaseous fuel. The method may also include directing the resulting gaseous fuel to a first locomotive and a second locomotive of the consist.

DETAILED DESCRIPTION

Figure 1:
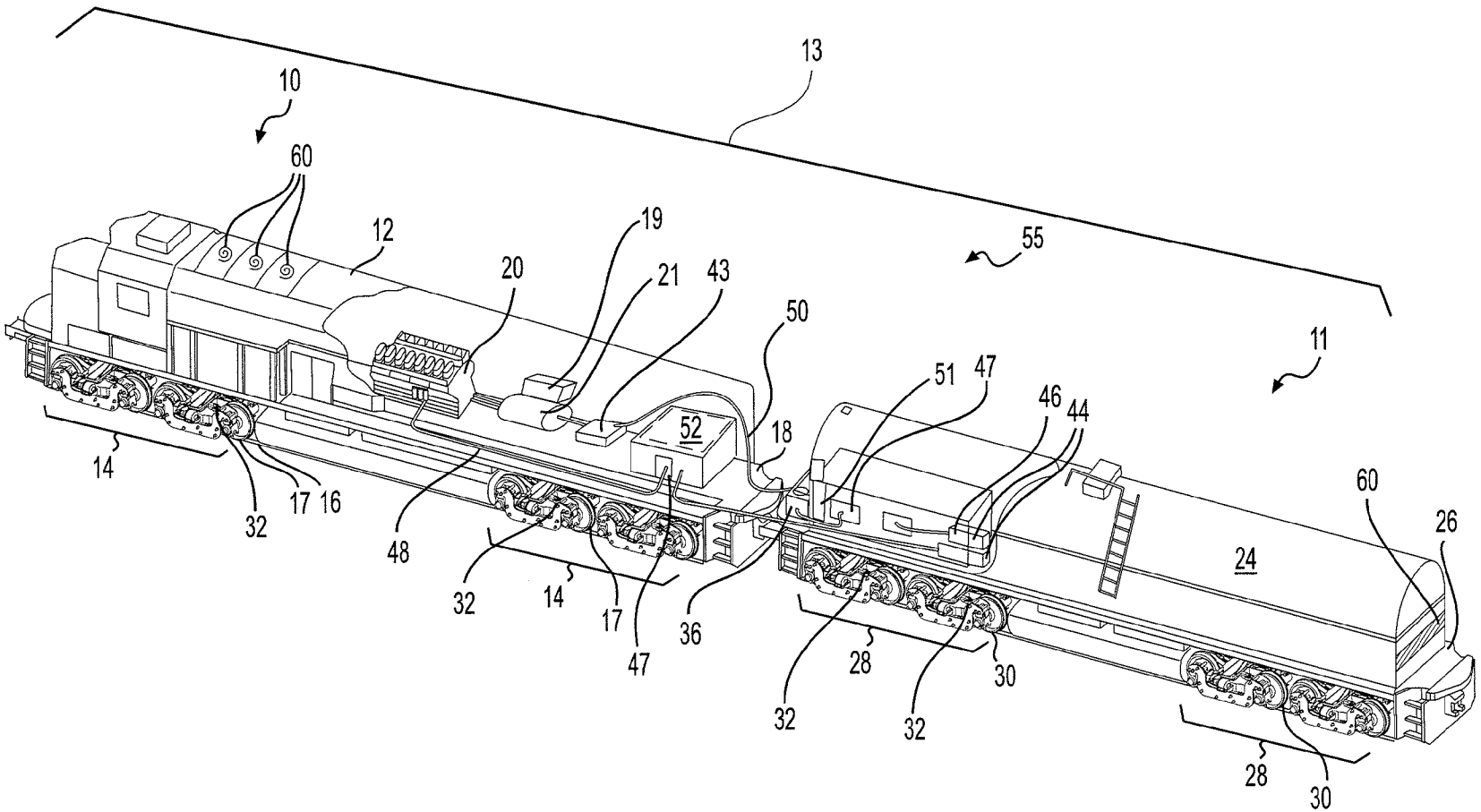
FIG. 1 is a pictorial illustration of an exemplary disclosed auxiliary power system.

FIG. 1 illustrates an exemplary embodiment of a locomotive 10 and a tender car 11 that is towed by locomotive 10. In some embodiments, additional cars may be towed by locomotive 10, for example, a passenger car (not shown), a cargo container car (not shown), or another type of car. Together, locomotive 10, tender car 11 and the other cars connected to them may comprise a consist 13.

Locomotive 10 may include a car body 12 supported at opposing ends by a plurality of trucks 14 (e.g., two trucks 14). Each truck 14 may be configured to engage a track 16 via a plurality of wheels 17, and support a frame 18 of car body 12. Any number of main engines 20 may be mounted to frame 18 and configured to produce electricity that drives wheels 17 included within each truck 14. In the exemplary embodiment shown in FIG. 1, locomotive 10 includes one main engine 20.

Main engine 20 may be a large engine, for example an engine having sixteen cylinders and a rated power output of about 4,000 brake horsepower (bhp). Main engine 20 may be configured to combust a gaseous fuel, such as natural gas, and generate a mechanical output that drives a main generator 21 to produce electric power. The electric power from main generator 21 may be used to propel locomotive 10 via one or more traction motors 32 associated with wheels 17 and, in some instances, directed to one or more auxiliary loads 43 of consist 13 (e.g., lights, heaters, refrigeration devices, air conditioners, fans, etc.). A switch 23 (shown only in FIG. 2) positioned on locomotive 10 may selectively connect main generator 21 to both traction motors 32 and auxiliary loads 43, to only traction motors 32, or to only auxiliary loads 43. Consequently, electric power from main generator 21 may be shared or dedicated solely to propulsion or auxiliary loads, as desired. It should be noted that main engine 20 may have a different number of cylinders, a different rated power output, and/or be capable of combusting another type of gaseous fuel, if desired.

Main generator 21 may be an induction generator, a permanent-magnet generator, a synchronous generator, or a switched-reluctance. In one embodiment, main generator 21 may include multiple pairings of poles (not shown), each pairing having three phases arranged on a circumference of a stator (not shown) to produce an alternating current.

Traction motors 32, in addition to providing the propelling force of consist 13 when supplied with electric power, may also function to slow locomotive 10. This process is known in the art as dynamic braking. When a traction motor 32 is not needed to provide motivating force, it can be reconfigured to operate as a generator. As such, traction motors 32 may convert the kinetic energy of consist 13 into electric energy, which has the effect of slowing consist 13. The electric energy generated during dynamic braking is typically transferred to one or more resistance grids 60 mounted on car body 12. At resistance grids 60, the electric energy generated during dynamic braking is converted to heat and dissipated into the atmosphere. Alternatively or additionally, electric energy generated from dynamic braking may be routed to an energy storage system 19 used to selectively provide supplemental power to traction motors 32.

Figure 2:
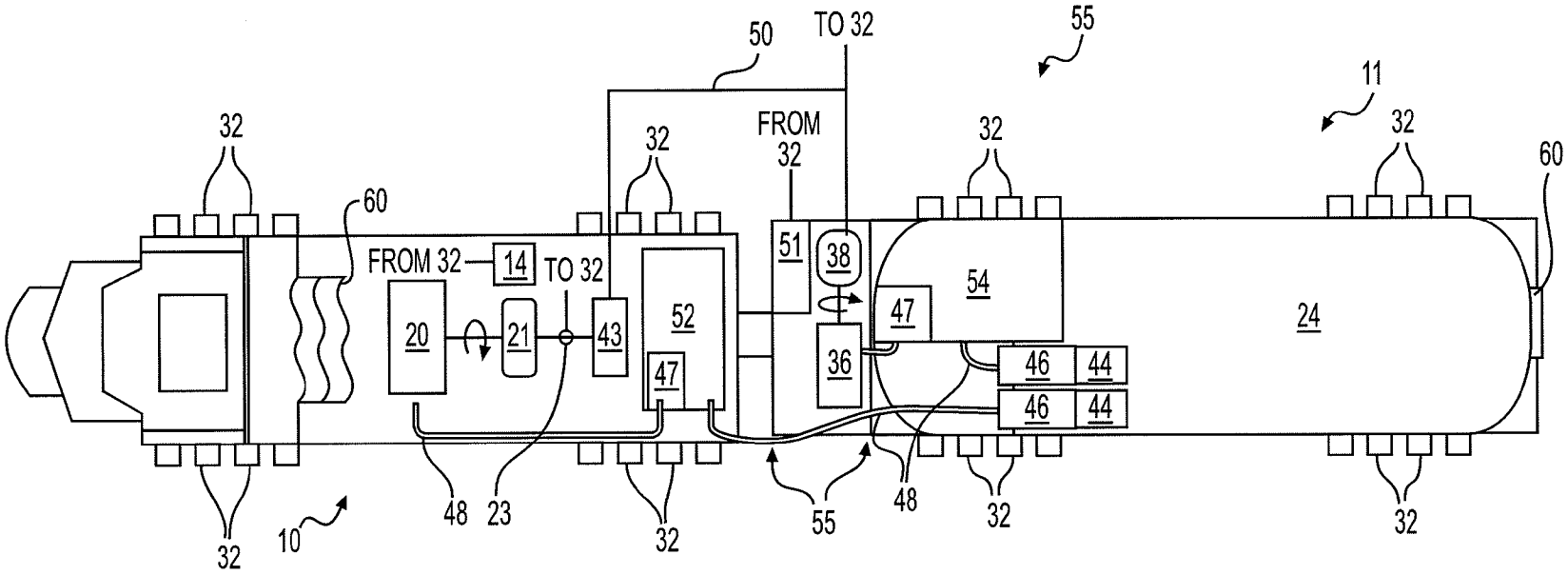
FIG. 2 is a diagrammatic illustration of a top view of the system displayed in FIG. 1.
Figure 3:
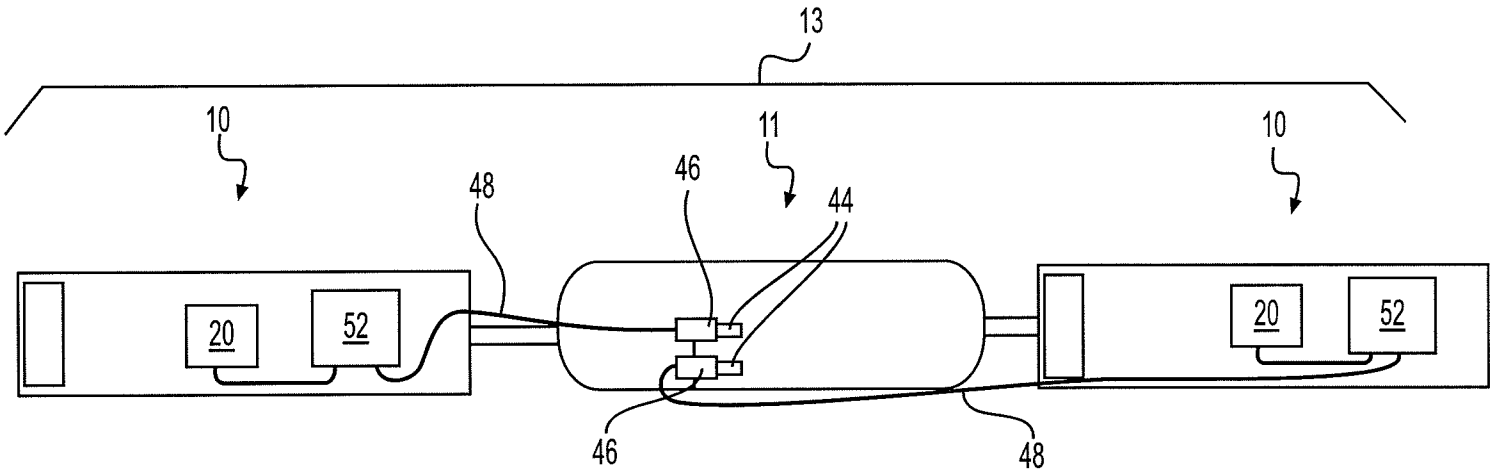
FIG. 3 is a diagrammatic illustration of an alternative embodiment of the system displayed in FIG. 1.

Tender car 11 may be provided with an auxiliary engine 36 that is mechanically connected to an auxiliary generator 38 (shown only in FIG. 2). Auxiliary engine 36 and auxiliary generator 38 may be mounted to a frame 26 that is supported by a plurality of trucks 28. Similar to truck 14, each truck 28 may be configured to engage track 16 via a plurality of wheels 30.

Auxiliary engine 36 may be smaller and have a lower rated output than main engine 20. For example, auxiliary engine 36 may have six to twelve cylinders and a rated power output of about 400-1400 bhp. It should be noted, however, that engines with a different number of cylinders or rated power output may alternatively be utilized, if desired. Similar to main engine 20, auxiliary engine 36 may combust natural gas or another type of gaseous fuel to generate a mechanical output used to rotate auxiliary generator 38. Auxiliary generator 38 may produce an auxiliary supply of electric power directed to one or more of the auxiliary loads 43 (i.e., loads not driven by main engine 20) of consist 13.

Auxiliary generator 38, in addition to providing electric power to auxiliary loads 43 of locomotive 10 or to the other cars of consist 13, may also provide electric power to one or more traction motors 32 on tender car 11, if desired. Similar to traction motors 32 located on locomotive 10, traction motors 32 of tender car 11 may function to propel tender car 11 by rotating wheels 30. In this manner, tender car 11 may be self-propelled and capable of moving about on its own power, independent of locomotive 10 or any other car (when uncoupled from locomotive 10 and the other cars).

Similar to locomotive 10, tender car 11 may generate its own electric energy via dynamic braking via traction motors 32. The generated electric power may be stored at an electric energy storage system 51 onboard tender car 11. Energy stored within system 51 may be selectively provided to traction motors 32 of tender car 11, and/or to any auxiliary load 43 of consist 13.

Auxiliary generator 38 and/or energy storage system 51 of tender car 11 may provide electric power to auxiliary loads 43 on locomotive 10 via an electric conduit 50. With this configuration, main engine 20 may be capable of shutting down or otherwise functioning at a reduced-output level and auxiliary loads 43 may continue to function normally by utilizing power provided by auxiliary generator 38.

Tender car 11 may also include one or more tanks 24 configured to store a liquid fuel (e.g., LNG) for combustion within main engine 20 and auxiliary engine 36. In the disclosed embodiment, a single tank 24 is shown. Tank 24 may be an insulated, single or multi-walled tank configured to store the liquid fuel at low temperatures, such as below about −160° C. Tanks 24 may be integral with frame 18 of tender car 11.

A fuel delivery circuit 55 may supply fuel from tank 24 to main engine 20 on locomotive 10 and to auxiliary engine 36 on tender car 11. Fuel delivery circuit 55 may include, among other things, one or more fuel pumps 44, one or more conduits 48, one or more heat exchangers 46, one or more accumulators (e.g., a main accumulator 52 and an auxiliary accumulator 54), and one or more injectors (not shown) that condition, pressurize or otherwise transport low-temperature liquid fuel, as is known in the art. Fuel delivery circuit 55 may also include one or more regulators 47 that help to regulate flow between main and auxiliary accumulators 52, 54 and engines 20, 36, respectively.

As illustrated in FIGS. 1 and 2, pumps 44 may each be situated near or within tank 24, and embody, for example, cryogenic pumps, piston pumps, centrifugal pumps, or any other pumps that are known in the industry. Pumps 44 may be powered by engines 20 and/or 36. Alternatively, pumps 44 may be powered by electric storage systems 19 and/or 51, if desired. Pumps 44 may pressurize the liquid fuel to an operating pressure of about 5,000 psi, and push the liquid fuel through heat exchangers 46 via conduits 48.

As illustrated in FIG. 1, heat exchangers 46 may have components situated near or within tank 24. Heat exchangers 46 may provide heat sufficient to vaporize the fuel as it is moved by pumps 44. Upon vaporization, the fuel may be transported via conduits 48 to, and stored at, accumulators 52, 54.

Accumulators 52, 54 on locomotive 10 and tender car 11, may be configured to receive pressurized gaseous fuel. Accumulators 52, 54 may embody, for example, compressed gas, membrane/spring, bladder-type, or other suitable accumulators configured to collect pressurized gaseous fuel and discharge the fuel to main engine 20 or auxiliary engine 36 via regulator 47.

Regulators 47 may be configured to selectively allow fluid communication between accumulators 52, 54 and main and auxiliary engines 20, 36, respectively. When regulators 47 open, they may allow gaseous fuel to escape accumulators 52, 54 and flow to main and/or auxiliary engines 20, 36. Regulators 47 may each include a spring-loaded mechanism (not shown) that opens at a predetermined pressure to avoid overpressurization of accumulators 52, 54. Additionally or alternatively, regulators 47 may each include one or more controllable actuators, such as one or more electric solenoids that are operable to open regulator 47 when actuated.

As illustrated in the simplified illustrations of FIGS. 3-6, tender car 11 may simultaneously transport fuel to multiple locomotives 10 of consist 13, in multiple different ways. For example, in FIG. 3, tender car 11 is shown as delivering fuel from a single location on tender car 11 to locomotives 10 at opposing ends of tender car 11. In this embodiment, each main engine 20 is fueled by a separate pump 44 that supplies fuel based on the unique demands each main engine 20 via separate conduits 48.

Figure 4:
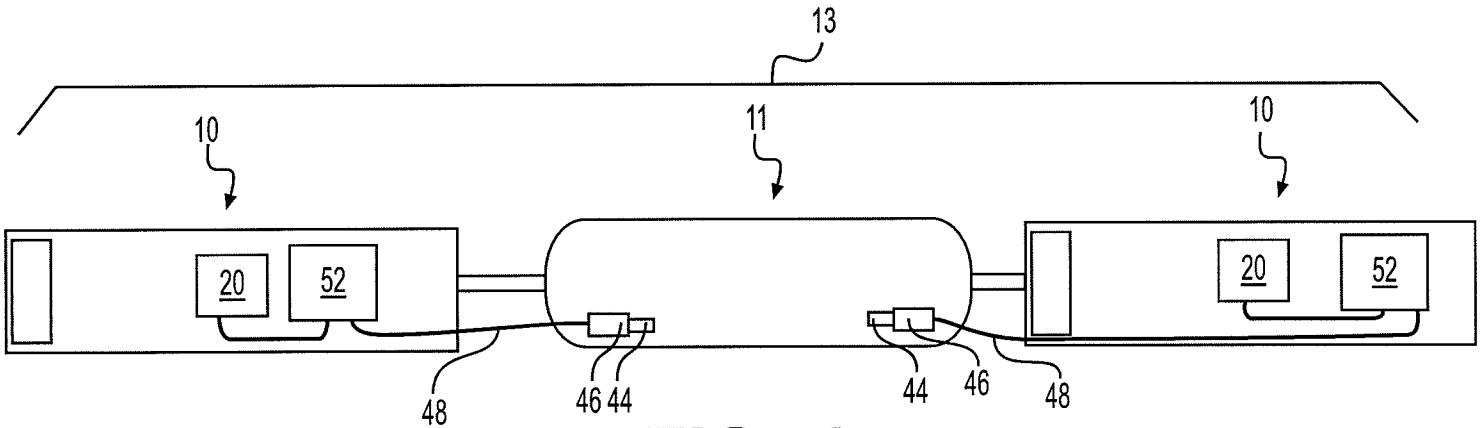
FIG. 4 is a diagrammatic illustration of another alternative embodiment of the system displayed in FIG. 1.

FIG. 4 illustrates another embodiment, wherein tender car 11 includes two pumps 44 delivering fuel through two separate conduits 48 from opposite ends of tender car 11. Locomotives 10 may be configured to receive fuel via conduit 48 from either a front end or a rear end, such that they may be fueled by either fore or aft-coupled tender cars 11.

Figure 5:
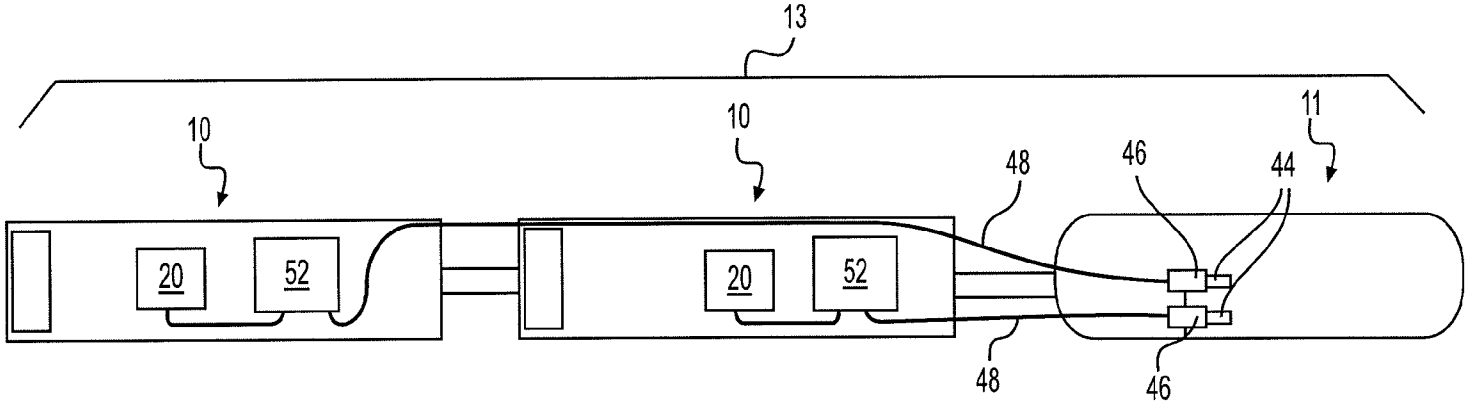
FIG. 5 is a diagrammatic illustration of another alternative embodiment of the system displayed in FIG. 1.

FIG. 5 illustrates another alternative embodiment, in which tender car 11 delivers fuel to two fore-coupled locomotives 10 with two separate pumps 44 located at the same end of tender car 11. In this embodiment, each engine 20 is fueled by a separate pump 44.

Figure 6:
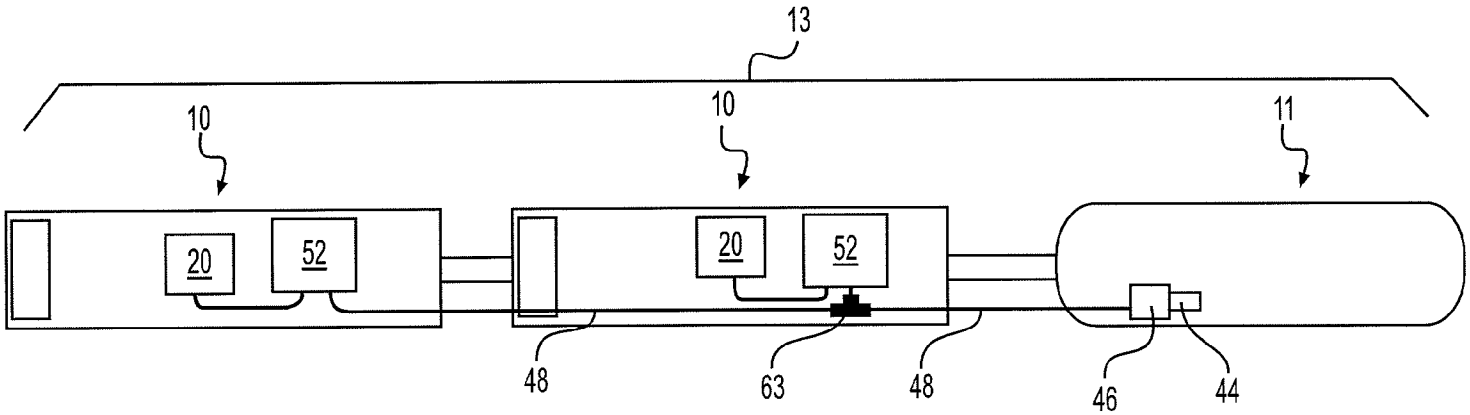
FIG. 6 is a diagrammatic illustration of another alternative embodiment of the system displayed in FIG. 1.

FIG. 6 illustrates tender car 11 having a single pump 44 in parallel fluid communication with two locomotives 10. In this configuration, a tee 63 may connect branching ends of conduit 48 to two main engines 20.

INDUSTRIAL APPLICABILITY

The disclosed fuel distribution system may be applicable to any consist 13 utilizing a low-temperature liquid fuel. The disclosed system may reduce a cost of consist 13, while also increasing a capacity and fuel consumption of the consist. In particular, the use of a single tender car 11 to fuel multiple locomotives reduces a component cost, operating cost, and maintenance cost of consist 13 simply by reducing a number of cars in consist 13. In addition, the reduction in the number of cars results in a weight reduction of consist 13 and a corresponding increase in the capacity of main engines 20 to pull consist 13 and a corresponding increase in fuel consumption.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A fuel distribution system for a consist, comprising:
a first locomotive;
a first engine associated with the first locomotive;
a second locomotive;
a second engine associated with the second locomotive
a tender car;
a first pump located onboard the tender car;
a second pump located onboard the tender car;
a first fluid conduit attached to the first pump and configured to deliver gaseous fuel from the tender car to the first locomotive for combustion of the gaseous fuel in the first engine; and
a second fluid conduit attached to the second pump and configured to deliver the gaseous fuel from the tender car to the second locomotive for combustion of the gaseous fuel in the second engine.

2. The fuel distribution system of claim 1, wherein the first and second pumps are positioned on a same end of the tender car.

3. The fuel distribution system of claim 2, wherein the tender car is between the first and second locomotives.

4. The fuel distribution system of claim 2, wherein the first and second locomotives are coupled directly to each other.

5. The fuel distribution system of claim 4, wherein the first conduit passes through the first locomotive to connect with the second locomotive.

6. The fuel distribution system of claim 1, wherein the first and second pumps are positioned at opposing ends of the tender car.

7. The fuel distribution system of claim 6, wherein the tender car is coupled between the first and second locomotives.

8. The fuel distribution system of claim 1, wherein each of the first and second conduits includes multiple conduits connected to each other by a tee.

9. The fuel distribution system of claim 1, wherein the tender car includes a tank configured to store a liquefied natural gas.

10. The fuel distribution system of claim 9, further including:
a first accumulator disposed on the first locomotive in fluid communication with the first conduit; and
a second accumulator disposed on the second locomotive in fluid communication with the second conduit.

11. The fuel distribution system of claim 10, wherein the first and second accumulators are configured to store gaseous fuel.

12. The fuel distribution system of claim 10, further including at least one regulator configured to control fuel flow from the first and second accumulators.

13. The fuel distribution system of claim 12, further including at least one heat exchanger configured to gasify the liquefied natural gas before it enters the first and second accumulators.

14. The fuel distribution system of claim 1, wherein the tender car includes an auxiliary engine configured to propel the tender car.

15. The fuel distribution system of claim 14, wherein the tender car includes a generator configured to be driven by the auxiliary engine.

* * * * *